US009377248B2

(12) United States Patent
Yoon et al.

(10) Patent No.: US 9,377,248 B2
(45) Date of Patent: Jun. 28, 2016

(54) INTEGRATED ACCUMULATOR AND RECEIVER HAVING A VIBRATION DAMPING GUIDE TUBE

(71) Applicant: LG ELECTRONICS INC., Seoul (KR)

(72) Inventors: Pilhyun Yoon, Seoul (KR); Hyeri Park, Seoul (KR); Jaehwa Jung, Seoul (KR); Yongcheol Sa, Seoul (KR); Seungyup Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 236 days.

(21) Appl. No.: 14/018,460

(22) Filed: Sep. 5, 2013

(65) Prior Publication Data

US 2014/0238650 A1 Aug. 28, 2014

(30) Foreign Application Priority Data

Feb. 28, 2013 (KR) ..... 10-2013-0021858

(51) Int. Cl.
*F25B 43/00* (2006.01)
*F28F 1/00* (2006.01)
*F25B 43/02* (2006.01)

(52) U.S. Cl.
CPC ..... *F28F 1/00* (2013.01); *F25B 43/006* (2013.01); *F25B 43/02* (2013.01)

(58) Field of Classification Search
CPC ..... F25B 43/02; F25B 43/006; F25B 40/00–40/06
USPC ..... 62/468, 470–473, 503, 509
See application file for complete search history.

(56) References Cited

U.S. PATENT DOCUMENTS

| | | | | | |
|---|---|---|---|---|---|
| 4,474,034 | A * | 10/1984 | Avery, Jr. | ..... | 62/503 |
| 5,007,247 | A * | 4/1991 | Danig | ..... | 62/174 |
| 5,134,859 | A * | 8/1992 | Jaster | ..... | 62/503 |
| 5,887,444 | A * | 3/1999 | Toyoshima et al. | ..... | 62/192 |
| 5,996,372 | A * | 12/1999 | Koda et al. | ..... | 62/503 |
| 6,038,875 | A * | 3/2000 | Haselden | ..... | 62/218 |
| 6,253,572 | B1 * | 7/2001 | Bottum et al. | ..... | 62/509 |
| 2005/0183436 | A1 * | 8/2005 | Jung et al. | ..... | 62/295 |
| 2006/0236716 | A1 * | 10/2006 | Griffin et al. | ..... | 62/503 |
| 2009/0107173 | A1 * | 4/2009 | Yoon et al. | ..... | 62/510 |

FOREIGN PATENT DOCUMENTS

| | | |
|---|---|---|
| EP | 0 841 487 | 5/1998 |
| WO | WO 96/20378 | 7/1996 |

OTHER PUBLICATIONS

European Search Report dated Jul. 30, 2014.

* cited by examiner

*Primary Examiner* — Cassey D Bauer
*Assistant Examiner* — Antonio R Febles
(74) *Attorney, Agent, or Firm* — Ked & Associates LLP

(57) ABSTRACT

An accumulator and an air conditioner having the same are provided. The air conditioner may include at least one indoor unit connected to an outdoor unit, the outdoor unit including a compressor compressing refrigerant and an accumulator transferring gas refrigerant into the compressor. The accumulator may include a housing, an inflow tube guiding refrigerant into the housing through a guide tube, and a discharge tube discharging the refrigerant from the housing. A portion of the guide tube protrudes out of the housing, and a distance between the discharge tube and a bottom of the housing is greater than that between the protruded portion of the guide tube and the bottom of the housing.

16 Claims, 7 Drawing Sheets

INTEGRATED ACCUMULATOR AND RECEIVER HAVING A VIBRATION DAMPING GUIDE TUBE

CROSS-REFERENCE TO RELATED APPLICATION(S)

This application claims priority under 35 U.S.C. §119 to Korean Application No. 10-2013-0021858 filed on Feb. 28, 2013, whose entire disclosure is hereby incorporated by reference.

BACKGROUND

1. Field

This relates to an accumulator and an air conditioner using the same.

2. Background

Air conditioners may discharge air into an inner space to adjust a temperature of the inner space and promote a pleasant indoor environment. Air conditioners may also have an air cleaning function for purifying indoor air. In general, such an air conditioner may include at least one indoor unit installed in at least one corresponding indoor space and an outdoor unit including a plurality of components such as a compressor and a heat exchanger to supply refrigerant to the at least one indoor unit. The air conditioner may operate in a cooling or heating mode which may be changed according to an operation state required by a user. That is, the air conditioner may perform the cooling operation or the heating operation according to a flow direction of the refrigerant.

BRIEF DESCRIPTION OF THE DRAWINGS

The embodiments will be described in detail with reference to the following drawings in which like reference numerals refer to like elements wherein.

DETAILED DESCRIPTION

Figure 1A:
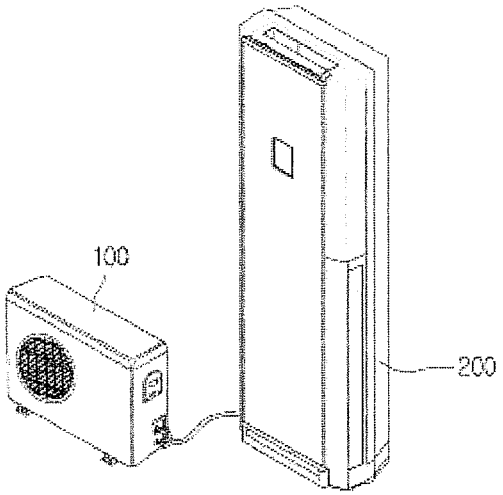
FIGS. 1A and 1B are views of air conditioning systems according to embodiments as broadly described herein.

Reference will now be made in detail to various embodiments, examples of which are illustrated in the accompanying drawings. In the following detailed description, reference is made to the accompanying drawings that form a part hereof, and in which is shown by way of illustration various exemplary embodiments. These embodiments are described in sufficient detail to enable those skilled in the art, and it is understood that other embodiments may be utilized and that logical structural, mechanical, electrical, and chemical changes may be made without departing from the spirit or scope as broadly described herein. To avoid detail not necessary to enable those skilled in the art, the description may omit certain information known to those skilled in the art. The following detailed description is, therefore, not to be taken in a limiting sense.

When an air conditioner performs a cooling operation, refrigerant compressed by the compressor of the outdoor unit may be converted into a high-temperature high-pressure liquid refrigerant as it passes through the heat exchanger of the outdoor unit. When the liquid refrigerant is supplied to an indoor unit, the refrigerant may be evaporated as it is expanded in a heat exchanger of the indoor unit, and a temperature of the surrounding air may be decreased by the evaporation. Also, the cool air may be discharged into the indoor space while an indoor unit fan rotates.

When the air conditioner performs a heating operation, high-temperature high-pressure gas refrigerant may be supplied from the compressor of the outdoor unit to the indoor unit, and the high-temperature high-pressure gas refrigerant may be liquefied in the heat exchanger of the indoor unit. Energy emitted by the liquefaction may increase a temperature of the surrounding air, and hot air may be discharged into the indoor space while an indoor unit fan rotates.

The outdoor unit may include a compressor that converts refrigerant to a high-temperature high-pressure gas state when the air conditioner performs the cooling or heating operation. The refrigerant circulating into a refrigerant cycle of the air conditioner may reach a state in which the liquid and gas are mixed while passing through an evaporator. Then, the refrigerant passing through the evaporator may be introduced again into the compressor. Thus, the air conditioner may include an accumulator for separating the liquid and gas from each other, to prevent the liquid from being introduced into the compressor so that only the gas is introduced into the compressor.

Such an accumulator may be disposed between the compressor and the evaporator to separate the liquid and gas so that only the gas refrigerant is introduced into the compressor. However, vibration and noise generated when the compressor operates may be transmitted into a tube connecting the accumulator to the compressor, thus deteriorating operation of the accumulator and causing possible malfunction of the accumulator.

Also, a portion of the refrigerant circulating through the refrigerant cycle of the air conditioner and oil may be collected in a lower portion of the accumulator. An integrated accumulator in which a receiver is mounted on the lower portion of the accumulator may be used to recover the oil collected in the lower portion of the accumulator into the compressor.

Figure 1B:
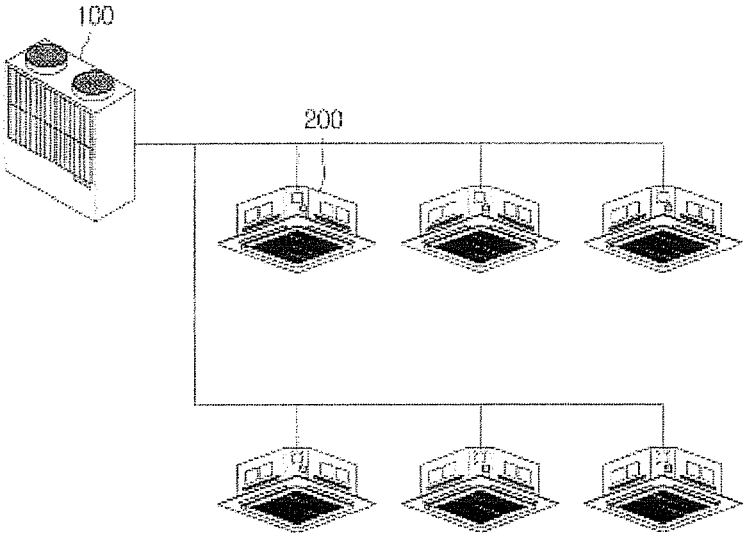

FIG. 1A is a view of an indoor unit and an outdoor unit of an exemplary stand type air conditioner, and FIG. 1B is a view of a plurality of indoor units and an outdoor unit of an exemplary ceiling type air conditioner. A stand type or ceiling type air conditioner will be described hereinafter, simply for ease of discussion. However, embodiments are not limited to a particular kind of air conditioner. For example, a wall mount type air conditioner or an integrated air conditioner in which an indoor unit and outdoor unit are not separated may also be applicable.

As shown in FIG. 1A, an air conditioner may include an indoor unit 200 discharging air-conditioned air into an indoor space and an outdoor unit 100 connected to the indoor unit 200 and disposed in an outdoor space. The indoor unit 100 and the outdoor unit 200 may be connected to each other by a refrigerant tube. Thus, cold air may be discharged from the indoor unit 200 into the indoor space by circulation of refrigerant. In certain embodiments, a plurality of indoor units 200 may be connected to the outdoor unit 100.

As shown in FIG. 1B, the air conditioner may include a plurality of indoor units 200 and at least one outdoor unit 100 connected to the plurality of indoor units 200. The plurality of indoor units 200 and the outdoor unit 100 may be connected to each other by a refrigerant tube. The plurality of indoor units 200 and the outdoor unit 100 may also be connected to each other by a communicable cable to transmit and receive control commands according to a predetermined communication method.

The air conditioner may also include a remote controller controlling the plurality of indoor units 200 and the outdoor unit 100, and a local controller connected to the indoor units 200 to receive a user input and output an operation state of each of the indoor units 200. The air conditioner may also include a ventilator, an air cleaner, a humidifier, a dehumidifier, a heater and the like. The remote controller may be connected to a lighting device and an alarm so that the remote controller, the lighting device, and the alarm may be mutually operable.

The indoor unit 200 may include a discharge hole through which heat-exchanged air is discharged. A wind direction adjustment device that opens or closes the discharge hole and controls a direction of the discharged air may be disposed in the discharge hole. The indoor unit 200 may also adjust a volume of air discharged from the discharge hole. A plurality of vanes may be disposed in a plurality of air suction holes and a plurality of air discharge holes. The vanes may open or close at least one of the plurality of air suction holes and the plurality of air discharge holes and also guide an air flow direction.

The indoor unit 200 may include a display device displaying an operation state and set information of the indoor unit 200 and an input device to receive input data. When a user inputs an operation command of the air conditioner at the input device, the outdoor unit 100 may operate in a cooling or heating mode corresponding to the input command. The outdoor unit 100 may supply the refrigerant to the plurality of indoor units 200, and the air flow direction may be guided along the discharge hole of the indoor unit 200 to adjust an indoor environment.

Figure 2:
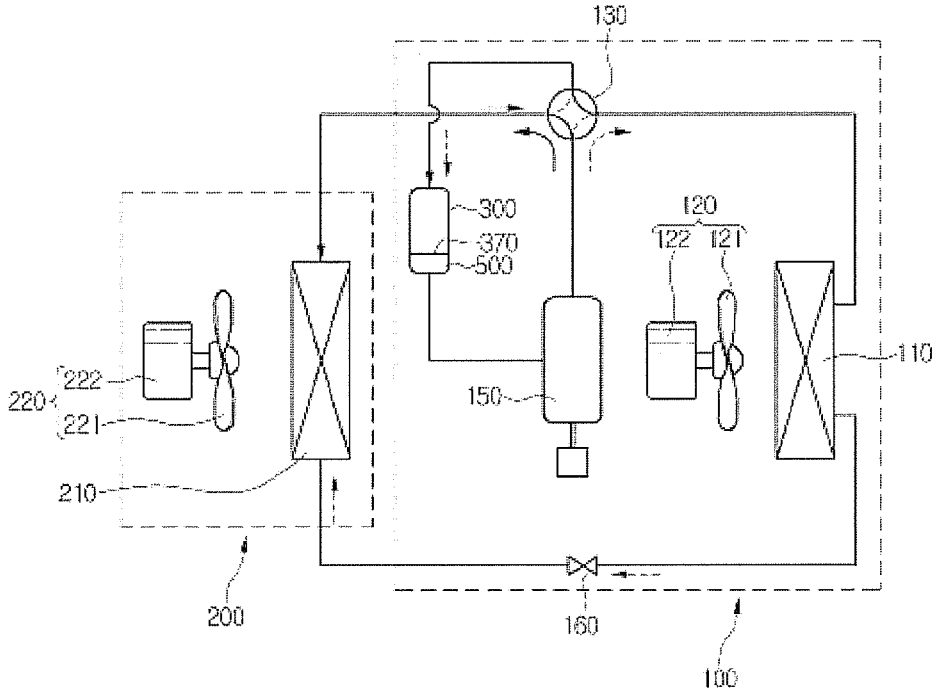
FIG. 2 is a schematic view of an air conditioner as shown in FIGS. 1A and 1B.

FIG. 2 is a schematic view of the indoor and outdoor units of the air conditioner, according to an embodiment as broadly described herein.

Referring to FIG. 2, the outdoor unit 100 may include an outdoor heat exchanger 110 in which outdoor air and refrigerant undergo heat-exchange, an outdoor air blower 120 drawing outdoor air into the outdoor heat exchanger 110, an accumulator 300 extracting a gas refrigerant, a compressor 150 compressing the gas refrigerant extracted by the accumulator 300, a four-way valve 130 switching a refrigerant flow direction, and an outdoor electronic expansion valve 160 controlled according to based on a degree of overcooling of overheating when a heating operation is performed.

When the air conditioner performs a cooling operation, the outdoor heat exchanger 110 may serve as a condenser in which a gas refrigerant transferred into the outdoor heat exchanger 110 is condensed by the outdoor air. Also, when the air conditioner performs a heating operation, the outdoor heat exchanger 110 may serve as an evaporator in which a liquid refrigerant transferred into the outdoor heat exchanger 110 is evaporated by the outdoor air.

The outdoor air blower 120 may include an outdoor motor 122 generating power and an outdoor fan 121 connected to the outdoor motor 122 to generate a blowing force as it rotates under the power of the outdoor motor 122.

In certain embodiments, the outdoor unit 100 may include two compressors. One of the two compressors may be an inverter, and the other may be a constant speed compressor. However, embodiments are not limited to a particular number and/or kind of compressor.

In certain embodiments, a outdoor units 100 may be provided, including, for example, a main outdoor unit and an auxiliary outdoor unit. The main outdoor unit and the auxiliary outdoor unit may be connected to the plurality of indoor units 200. The main outdoor unit and the auxiliary outdoor unit may operate to fulfill a requirement of at least one of the plurality of indoor units 200. For example, first, the main outdoor unit may operate to correspond to the number of operating indoor units. Then, when a cooling or heating capacity varies and exceeds an allowable capacity of the main outdoor unit, the auxiliary outdoor unit may operate. That is, the number of operating outdoor units and an operation of the compressor provided in the outdoor unit may vary to correspond to a required cooling or heating capacity.

The indoor unit 200 may include an indoor heat exchanger 210 in which indoor air and a refrigerant undergo heat-exchange, an indoor air blower 220 drawing indoor air into the indoor heat exchanger 210, and an indoor electronic expansion valve to adjust an indoor unit flow rate according to a degree overcooling or overheating.

When the air conditioner performs the cooling operation, the indoor heat exchanger 210 may serve as an evaporator in which a liquid refrigerant transferred into the indoor heat exchanger 210 is evaporated by the indoor air. Also, when the air conditioner performs the heating operation, the indoor heat exchanger 210 may serve as a condenser in which a gas refrigerant transferred into the indoor heat exchanger 210 is condensed by the indoor air.

The indoor air blower 220 may include an indoor motor 222 generating power and an indoor fan 221 connected to the indoor motor 222 to generate a blowing force as it rotates under the power of the indoor motor 222.

In certain embodiments, the air conditioner may be configured as a cooler cooling the indoor space. In other embodiments, the air conditioner may be configured as a heat pump cooling or heating the indoor space.

As described above, the air conditioner may provide a space in which refrigerant flows to perform the cooling or heating operation. Particularly, a plurality of components may be disposed in the outdoor unit 100 and the indoor unit 200 of the air conditioner. The plurality of components may include a refrigerant tube that defines a path along which the refrigerant may flow for heat-exchange with external air.

When the air conditioner performs the cooling or heating operation, the refrigerant may circulate through one refrigerant cycle to pass through the refrigerant tube. That is, when the air conditioner operates, refrigerant compressed into a high-temperature high-pressure gas state by the compressor 150 may pass through the refrigerant cycle and then be introduced into the compressor 150 again via the evaporator. However, the refrigerant passing through the evaporator may have a state in which a gas and a liquid are mixed with each other. Thus, the accumulator 300 separating the gas and the liquid from each other may be disposed between the compressor 150 and the evaporator. The accumulator 300 may serve as a gas/liquid separator so that only a gas refrigerant of the refrigerant passing through the evaporator is introduced into the compressor 150. A receiver 500 providing a storage space for the refrigerant may be disposed under the accumulator 300.

Hereinafter, a plurality of tubes connected to the accumulator 300 will be described, referring to FIG. 3, which illustrates a refrigerant tube of an accumulator according to an embodiment, and FIG. 4, which is a cross-sectional view taken along line I-I' of FIG. 3.

Figure 3:
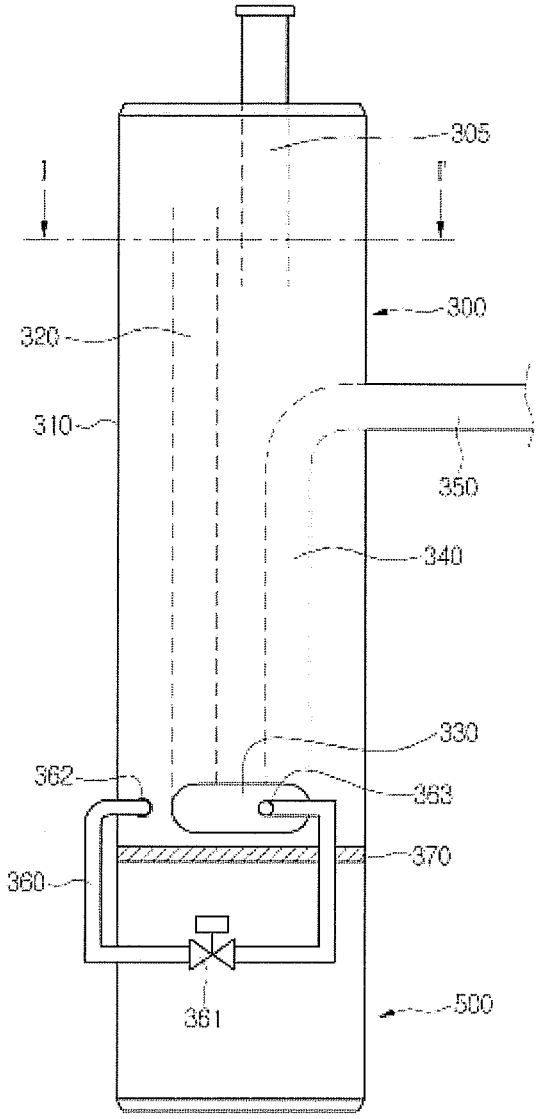
FIG. 3 is a view of a refrigerant tube of an accumulator of an air conditioner, according to an embodiment as broadly described herein.
Figure 4:
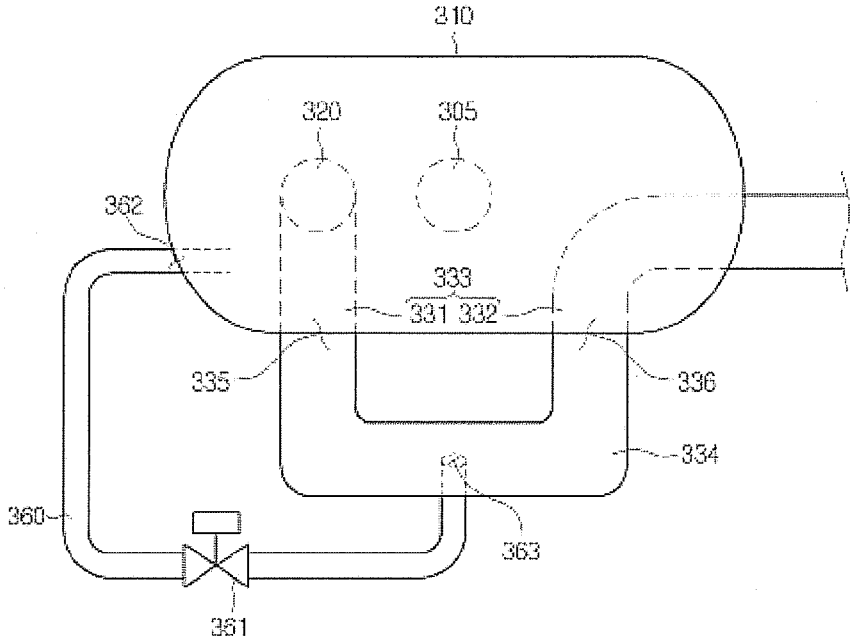
FIG. 4 is a cross-sectional view taken along line I-I' of FIG. 3.

Referring to FIGS. 3 and 4, the accumulator 300 may include a housing 310 and a plurality of refrigerant tubes to provide a flow path for the refrigerant through the housing 310. The refrigerant tubes may include an inflow tube 305 through which refrigerant that has passed through the evaporator may be introduced into the accumulator 300, a first guide tube 320 that receives gas refrigerant of the refrigerant introduced into the housing 310 though the inflow tube 305, a second guide tube 330 communicating with the first guide tube 320, a third guide tube 340 communicating with the second guide tube 330 and disposed parallel to the first guide tube 320, and a discharge tube 350 communicating with the third guide tube 340 to guide the discharge of refrigerant from the accumulator 300 to the compressor 150.

The first guide tube 320 may be disposed perpendicular to a bottom surface of the housing 310. An upper portion of the first guide tube 320 may be disposed above a lower portion of the inflow tube 305. The first guide tube 320 may be disposed within the housing 310.

The second guide tube 330 may be disposed parallel to the bottom surface of the housing 310. The second guide tube 330 may include an internal discharge tube 333 disposed within the housing 310 and an external discharge tube 334 disposed outside the housing 310. The internal discharge tube 333 and the external discharge tube 334 may communicate with each other.

The internal discharge tube 333 may include a first internal discharge tube 331 having a first end connected to the first guide tube 320 and a second end connected to the external discharge tube 334, and a second internal discharge tube 332 having a first end connected to the external discharge tube 334 and as second end connected to the third guide tube 340.

The housing 310 may have a first through hole 335 discharging refrigerant from the first internal discharge tube 331 into the external discharge tube 334, and a second through hole 336 discharging refrigerant from the second internal discharge tube 332 into the external discharge tube 334. The plurality of through holes 335 and 336 may be disposed in a lower portion of a side surface of the housing 310. However, embodiments are not limited to these positions of the plurality of through holes 335 and 336.

The third guide tube 340 may be disposed perpendicular to the bottom surface of the housing 310. That is, the third guide tube 340 may be disposed parallel to the first guide tube 320 and perpendicular to the second guide tube 330. The third guide tube 340 may be disposed within the housing 310. Refrigerant passing through the third guide tube 340 may be discharged into the compressor 150 through the discharge tube 350.

A receiver 500 providing a refrigerant storage space may be disposed under the housing 310. When the air conditioner operates, the receiver 500 may store extra refrigerant of the refrigerant circulating through the system. The receiver 500 may have an upper end contacting a lower end of the accumulator 300. A blocking part 370 may be disposed between the upper end of the receiver 500 and the lower end of the accumulator 300 to preserve performance of the receiver 500. The blocking part 370 may be formed of, for example, an insulation material. However, embodiments are not limited to this material of the blocking part 370.

An oil guide tube 360 discharging oil to the compressor 150 may be disposed at the second guide tube 330. Particularly, an oil hole 362 providing a moving path for the oil may be defined in a lower portion of the side surface of the housing 310. Oil accumulated in the bottom of the housing 310 may pass through the oil hole 362 and through an insertion hole 363 defined in the external discharge tube 334 along the oil guide tube 360 and then be discharged to the compressor 150. An oil valve 361 controlling a flow of the oil may be disposed in the oil guide tube 360. Whether the oil flows along the oil guide tube 360 may be determined according to opening or closing of the oil valve 361.

The oil passing through the oil guide tube 360 may be mixed with the gas refrigerant passing through the second guide tube 330 to flow into the compressor 150. Thus, to easily mix the gas refrigerant and the oil with each other, a diameter of the oil guide tube 360 may be less than or equal to that of the second guide tube 330.

The opening or closing of the oil valve 361 may be directly performed by the user, or may be performed by a controller of the air conditioner. For example, when operation of the compressor 150 is stopped, it may not be necessary to supply the oil to the compressor 150. Here, if the controller of the air conditioner controls the opening or closing of the oil valve 361, the controller closes the oil valve 361 to prevent oil from unnecessarily flowing into the compressor 150.

When oil is excessively supplied to the compressor 150, turbulence of the oil supplied to the compressor 150 may occur. Thus, when the compressor 150 operates, the oil as well as the refrigerant may be compressed, deteriorating efficiency of the compressor 150. Thus, when operation of the compressor 150 is stopped, the controller may control the oil valve 361 so that oil valve 361 is closed to prevent the oil from being unnecessarily supplied to the compressor 150.

A hydrostatic pressure of the oil passing through the oil guide tube 360 may be greater than those of the gas refrigerant and the liquid refrigerant which are introduced into the housing 310. Thus, the oil hole 362 may be defined above the through holes 335 and 336. That is, a vertical flow height of the oil introduced into the oil guide tube 360 with respect to the bottom surface of the housing 310 may be greater than that of the oil discharged from the oil guide tube 360.

Figure 5:
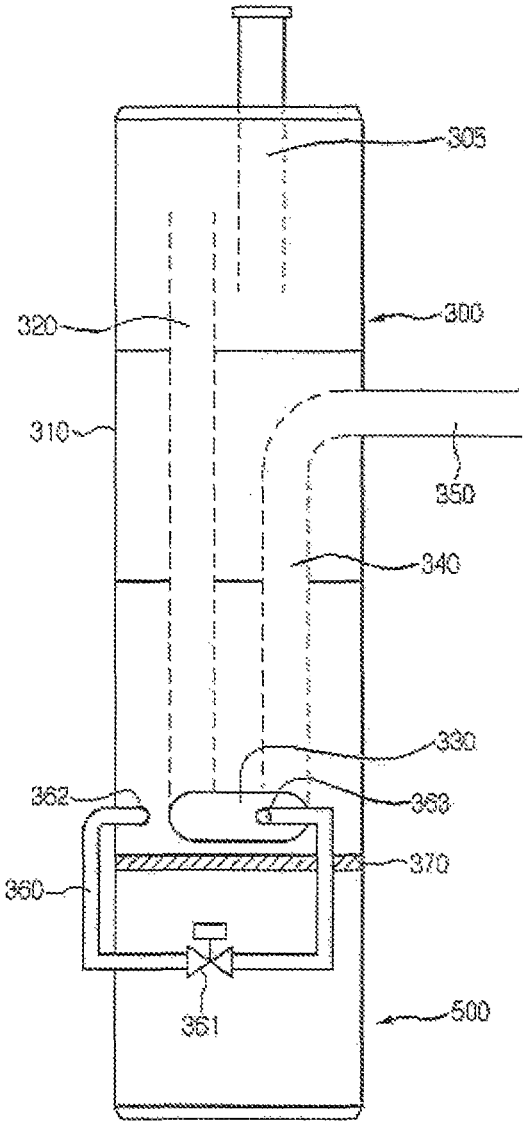
FIG. 5 is a view of refrigerant and oil within an accumulator of an air conditioner, according to an embodiment as broadly described herein.

FIG. 5 illustrates an arrangement of refrigerant and oil within an accumulator of an air conditioner, according to an embodiment, as broadly described herein.

Referring to FIG. 5, a material flowing into the housing 310 along the inflow tube 305 may include gas refrigerant, liquid refrigerant, and oil. In specific gravities of the inflow materials, the oil is highest, and the gas refrigerant is lowest. Thus, the gas refrigerant may be accommodated in an upper portion of the housing 310, and the oil may be accommodated in a lower portion of the housing 310. The liquid refrigerant may be accommodated between the gas refrigerant and the oil. A process in which the inflow material flows along the plurality of tubes will be described below.

The gas refrigerant introduced into the housing 310 through the inflow tube 305 may flow into the first guide tube 320 disposed within the housing 310. The gas refrigerant flowing along the first guide tube 320 may flow into the first internal discharge tube 331, pass through the first through hole 335 into the external discharge tube 334, through the second through hole 336 and into the second internal discharge tube 332 disposed within the housing 310. The gas refrigerant passing through the second internal discharge tube 332 may successively pass through the third guide tube 340 and the discharge tube 350 for discharge to the compressor 150.

The liquid refrigerant introduced into the housing 310 through the inflow tube 305 may be stored in the housing 310.

The oil introduced into the housing 310 through the inflow tube 305 may pass through the oil guide tube 360 and then be discharged into the external discharge tube 334 according to the operation mode of the air conditioner and/or a load requirement of the system.

As described above, since the first guide tube 320, the internal discharge tubes 331 and 332 of the second guide tube 330, and the third guide tube 340 are disposed within the housing 310, malfunction of the accumulator 300 due to noise and vibration generated by the operation of the compressor 150 may be minimized.

Figure 6:
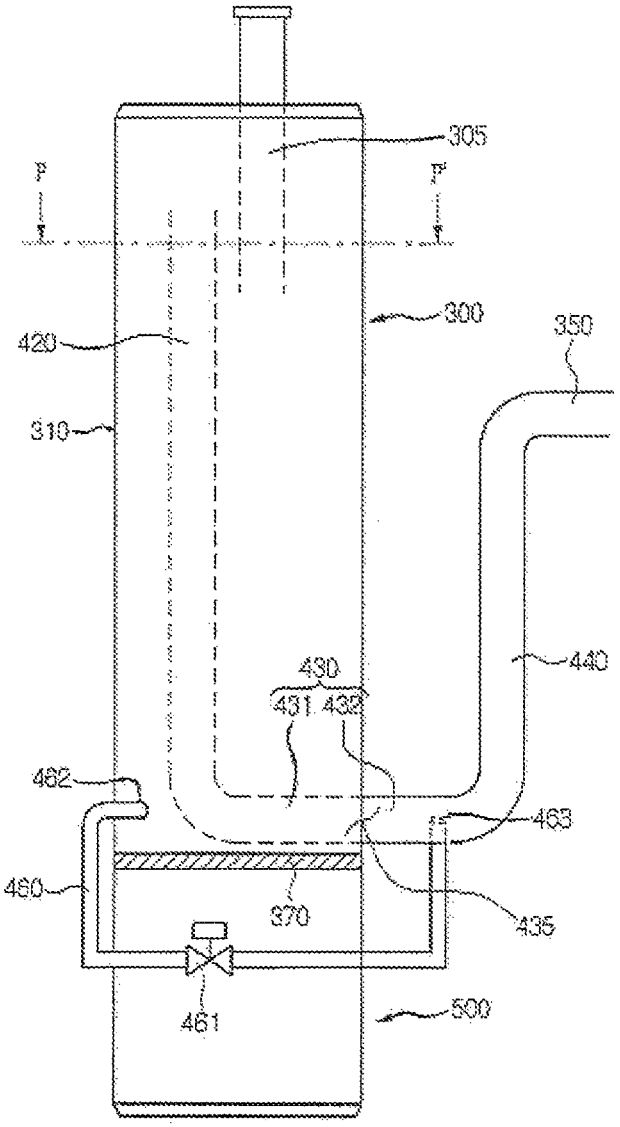
FIG. 6 is a view of a refrigerant tube of an accumulator of an air conditioner, according to another embodiment as broadly described herein.
Figure 7:
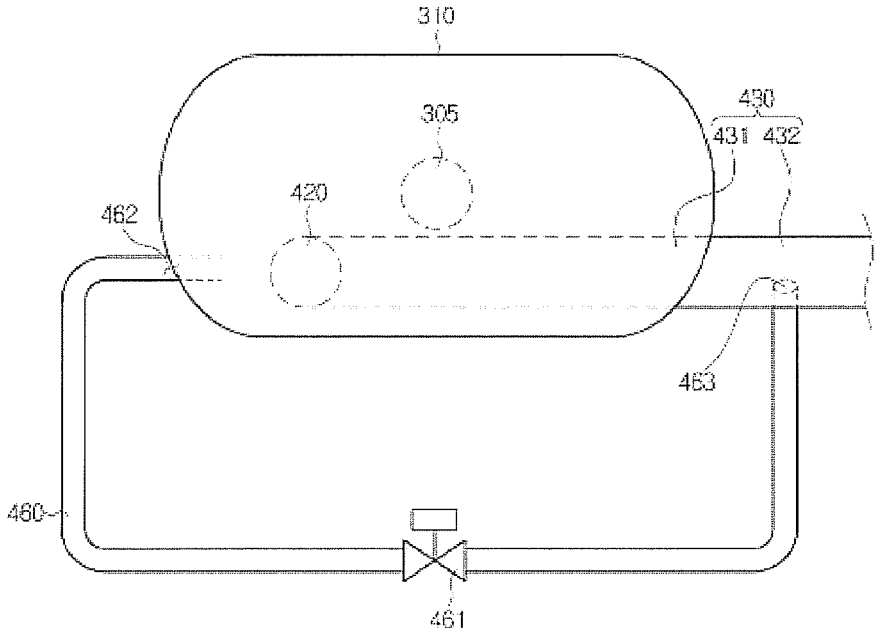
FIG. 7 is a cross-sectional view taken along line P-P' of FIG. 6.

FIG. 6 illustrates a refrigerant tube of an accumulator according to another embodiment as broadly described herein, and FIG. 7 is a cross-sectional view taken along line P-P' of FIG. 6.

The embodiment shown in FIGS. 6 and 7 is substantially the same as the foregoing embodiment except for constitutions of a refrigerant tube and an oil guide tube. Thus, the same or similar component in the two embodiments may be designated by the same reference numeral. Hereinafter, different points between the embodiments will be mainly described.

Referring to FIGS. 6 and 7, a refrigerant tube according to the current embodiment may include a first guide tube 420 disposed within a housing 310, a second guide tube 430 communicating with the first guide tube 420, and a third guide tube 440 communicating with the second guide tube 430 and disposed outside the housing 310. The second guide tube 430 may include an internal discharge tube 431 disposed within the housing 310 and an external discharge tube 432 disposed outside the housing 310. The internal discharge tube 431 and the external discharge tube 432 may communicate with each other.

A communication hole 435 providing a moving path for refrigerant discharged from the internal discharge tube 431 to flow into the external discharge tube 432 may be defined in a lower portion of a side surface of the housing 310. An oil hole 462 providing a moving path for the oil may be defined in a lower portion of the other side surface of the housing 310. The oil passing through the oil hole 462 may pass through an insertion hole 463 defined in the oil guide tube 460 and then be discharged into a compressor 150.

The oil passing through the oil guide tube 460 has a hydrostatic pressure greater than that of a gas refrigerant or liquid refrigerant which is introduced into the housing 310. Thus, the oil hole 462 may be defined above the communication hole 435. That is, a vertical flow height of the oil introduced into the oil guide tube 460 with respect to the bottom surface of the housing 310 may be greater than that of the oil discharged from the oil guide tube 460.

An oil valve 461 controlling a flow of the oil may be disposed in the oil guide tube 460. Whether the oil flows along the oil guide tube 460 may be determined according to opening or closing of the oil valve 461.

Since an operation method of each of the components and a flow method of the oil and refrigerant are the same as those according to the foregoing embodiment, their descriptions will be omitted.

In the current embodiment, since the first guide tube 420 and the internal discharge tube 431 of the second guide tube 430 are disposed within the housing 310, malfunction of an accumulator 300 due to noise and vibration generated by the operation of the compressor 150 may be minimized.

Embodiments provide an accumulator in which vibration and noise generated in a tube connecting a compressor to the accumulator when the compressor operates may be minimized to perform normal operation thereof and an air conditioner using the same.

In one embodiment, an accumulator as broadly described herein may include a housing defining an outer appearance, an inflow tube guiding introduction of a refrigerant into the housing, a guide tube providing a moving path of the refrigerant introduced from the inflow tube, and a discharge tube discharging the refrigerant passing through the guide tube to the outside of the housing, wherein a portion of the guide tube protrudes from an inner space of the housing toward an outer space of the housing, and a distance between the discharge tube and a bottom surface of the housing is greater than that between the portion of the guide tube and the bottom surface of the housing.

In another embodiment, an air conditioner as broadly described herein may include an indoor unit air-conditioning indoor air, and an outdoor unit connected to the indoor unit, the outdoor unit including a compressor compressing a refrigerant and an accumulator transferring a gas refrigerant into the compressor, wherein the accumulator may include a housing defining an outer appearance, and a guide tube guiding movement of the refrigerant accommodated in the housing, wherein a portion of the guide tube protrudes from an inner space of the housing toward an outer space of the housing, and a distance between the discharge tube and a bottom surface of the housing is greater than that between the portion of the guide tube and the bottom surface of the housing.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An accumulator, comprising:

a housing that defines an inner space;

an inflow tube through which a refrigerant is guided into the housing;

a guide tube that provides a flow path for the refrigerant introduced into the housing through the inflow tube; and a discharge tube connected to the guide tube, through which the refrigerant from the guide tube is discharged to an outside of the housing, wherein the guide tube includes:

a first guide tube that is separate from the inflow tube, and that receives and guides the refrigerant introduced into the housing;

a second guide tube in communication with the first guide tube; and a third guide tube having a first end connected to the second guide tube and a second end connected to the discharge tube, wherein the first guide tube and the third guide tube are provided inside of the housing, wherein a portion of the second guide tube is provided outside of the housing, and wherein a distance between the discharge tube and a bottom surface of the housing is greater than a distance between the portion of the second guide tube provided outside of the housing and the bottom surface of the housing.

2. The accumulator according to claim 1, wherein the second guide tube protrudes from the inner space to the outside of the housing through a lateral side wall of the housing.

3. The accumulator according to claim 1, wherein the second guide tube is oriented perpendicular to the first guide tube.

4. The accumulator according to claim 1, wherein the second guide tube includes:

an internal discharge portion provided inside the housing to guide movement of the refrigerant; and an external discharge portion provided outside the housing to guide movement of the refrigerant.

5. The accumulator according to claim 4, wherein the internal discharge portion includes:

a first internal discharge portion having a first end connected to the first guide tube and a second end connected to the external discharge portion; and a second internal discharge portion having a first end connected to the external discharge portion and a second end connected to the third guide tube.

6. The accumulator according to claim 5, further including first and second through holes, wherein the refrigerant discharged from the first internal discharge portion moves into the external discharge portion through the first through hole, and wherein the refrigerant discharged from the external discharge portion moves into the second internal discharge portion through the second through hole.

7. The accumulator according to claim 1, further including an oil hole formed in a side surface of the housing.

8. The accumulator according to claim 7, further including an oil guide tube that guides oil discharged from the housing through the oil hole into the guide tube.

9. The accumulator according to claim 8, wherein a distance from the oil hole to the bottom surface of the housing is greater than a distance from the second guide tube to the bottom surface of the housing.

10. The accumulator according to claim 8, further including an oil valve provided in the oil guide tube to adjust an amount of oil flowing along the oil guide tube.

11. An air conditioner including the accumulator of claim 1.

12. An air conditioner, comprising:

at least one indoor device; and an outdoor device connected to the at least one indoor device, the outdoor device including an accumulator that transfers a gas refrigerant to a compressor, wherein the accumulator includes:

a housing;

an inflow tube that guides a refrigerant into the housing;

a guide tube that guides a flow of the refrigerant through the housing; and a discharge tube to discharge the refrigerant from the guide tube to the compressor, wherein the guide tube includes:

a first guide tube that is separate from the inflow tube, and that the first guide tube receives and guides the refrigerant introduced into the housing;

a second guide tube in communication with the first guide tube; and a third guide tube having a first end connected to the second guide tube and a second end connected to the discharge tube, wherein the first guide tube and the third guide tube are provided inside of the housing, wherein a portion of the second guide tube protrudes out of the housing, and wherein a distance between the discharge tube and a bottom surface of the housing is greater than a distance between the protruded portion of the second guide tube and the bottom surface of the housing.

13. The air conditioner according to claim 12, wherein the second guide tube includes:

first and second internal discharge portion provided inside the housing; and an external discharge portion provided outside the housing and coupled to the first and second internal discharge portions.

14. The air conditioner according to claim 13, further including a receiver coupled to the housing to provide a refrigerant storage space, wherein a top surface of the receiver is connected to a bottom surface of the accumulator and is positioned below the external discharge portion of the second guide tube.

15. The air conditioner according to claim 13, further including first and second through holes formed in a side surface of the housing, wherein the first through hole defines a passage through which the refrigerant discharged from the first internal discharge portion moves into the external discharge portion, and wherein the second through hole defines a passage through which the refrigerant discharged from the external discharge portion moves into the second internal discharge portion.

16. An accumulator and receiver assembly, comprising:

a housing that defines an inner space;

a partition that extends across the housing to partition the inner space into an accumulator space above the partition and a receiver space below the partition;

an inflow tube that provides a refrigerant to the accumulator space;

a guide tube that guides the refrigerant through the accumulator space;

discharge tube in communication with the guide tube, that discharges the refrigerant received from the guide tube to the compressor; and an oil guide that extends between a lower portion of the accumulator pace and the guide tube to supply oil to be discharged to the compressor with the refrigerant through the discharge tube, where in the guide tube includes:

a first guide tube provided in the accumulator space, that is separate from the inflow tube;

a second guide tube in communication with the first guide tube; and a third guide tube provided in the accumulator space and having a first end connected to the second guide tube and a second end connected to the discharge tube, and where a portion of the second guide tube is provided outside of the housing.

* * * * *